US010446115B2

(12) United States Patent
Ropo et al.

(10) Patent No.: US 10,446,115 B2
(45) Date of Patent: Oct. 15, 2019

(54) CROWD-SOURCED BRIGHTNESS FOR A DISPLAY

(71) Applicant: Microsoft Technology Licensing, LLC, Redmond, WA (US)

(72) Inventors: Kari Jussi Ropo, Redmond, WA (US); Samu Kallio, Redmond, WA (US); Katherine Blair Huffman, Seattle, WA (US); Jocelyn Berrendonner, Kirkland, WA (US); Tyler Donahue, Bellevue, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 125 days.

(21) Appl. No.: 15/397,670

(22) Filed: Jan. 3, 2017

(65) Prior Publication Data

US 2018/0190240 A1 Jul. 5, 2018

(51) Int. Cl.

| | |
|---|---|
| ***G09G 5/10*** | (2006.01) |
| ***G09G 5/30*** | (2006.01) |
| ***G09G 5/391*** | (2006.01) |

(52) U.S. Cl.

CPC ..... *G09G 5/10* (2013.01); *G09G 5/30* (2013.01); *G09G 5/391* (2013.01); *G09G 2320/0606* (2013.01); *G09G 2320/0626* (2013.01); *G09G 2354/00* (2013.01); *G09G 2360/144* (2013.01); *G09G 2370/042* (2013.01)

(58) Field of Classification Search

CPC .... G09G 5/02; G09G 5/06; G09G 2320/0666; G09G 2340/06; G06T 11/001

See application file for complete search history.

(56) References Cited

U.S. PATENT DOCUMENTS

| | | | | |
|---|---|---|---|---|
| 6,094,185 | A | 7/2000 | Shirriff | |
| 7,301,545 | B2 * | 11/2007 | Park | G09G 5/10 345/594 |
| 8,040,341 | B2 | 10/2011 | Lin | |
| 8,610,659 | B2 | 12/2013 | Fletcher et al. | |
| 9,097,891 | B2 | 8/2015 | Border et al. | |
| 9,106,721 | B2 | 8/2015 | Quan | |

(Continued)

OTHER PUBLICATIONS

"Auto Brightness: How to Improve the Android Mobile Operating System in Handheld Consumer Devices", In White Paper of quickLogic, Sep. 9, 2014, pp. 1-19.

(Continued)

*Primary Examiner* — Abderrahim Merouan

(74) *Attorney, Agent, or Firm* — Alleman Hall Creasman & Tuttle LLP

(57) ABSTRACT

Computing devices and methods for adjusting light output of a display in a user computing device are disclosed. In one example, user-adjusted brightness settings are received from a plurality of computing devices. For each brightness setting, a corresponding environment brightness level determined contemporaneously with execution of the user-adjusted brightness setting is also received. At least one crowd-sourced brightness curve is generated using the user-adjusted brightness settings and the corresponding environment brightness levels. When a trigger event occurs, the at least one crowd-sourced brightness curve is distributed to the user computing device.

20 Claims, 7 Drawing Sheets

(56) References Cited

U.S. PATENT DOCUMENTS

| | | | | |
|---|---|---|---|---|
| 9,426,867 | B2 | 8/2016 | Beghelli | |
| 9,666,121 | B2 * | 5/2017 | Aoyama | G09G 3/20 |
| 2002/0163524 | A1 | 11/2002 | Dutta | |
| 2006/0092182 | A1 * | 5/2006 | Diefenbaugh | G06F 1/3218 345/690 |
| 2008/0165116 | A1 * | 7/2008 | Herz | G09G 3/3406 345/102 |
| 2008/0291139 | A1 * | 11/2008 | Hsieh | G09G 3/20 345/77 |
| 2010/0295873 | A1 | 11/2010 | Dodge et al. | |
| 2011/0050719 | A1 | 3/2011 | Diefenbaugh et al. | |
| 2012/0019492 | A1 | 1/2012 | Barnhoefer et al. | |
| 2013/0155126 | A1 * | 6/2013 | Lathrop | G06F 1/3218 345/690 |
| 2014/0133825 | A1 * | 5/2014 | Kozloski | G11B 27/034 386/223 |
| 2014/0153820 | A1 * | 6/2014 | Lee | G06T 5/007 382/162 |
| 2015/0009348 | A1 * | 1/2015 | Vartanian | H04N 5/23206 348/211.3 |
| 2015/0253934 | A1 * | 9/2015 | Lin | G06F 3/0428 345/175 |
| 2017/0053604 | A1 * | 2/2017 | Li | H04M 1/725 |
| 2017/0257303 | A1 * | 9/2017 | Boyapalle | H04L 67/34 |
| 2017/0262758 | A1 * | 9/2017 | Boyapalle | G06F 21/00 |

OTHER PUBLICATIONS

Soneira, Raymond M., "Galaxy S7 OLED Display Technology Shoot-Out Samsung Galaxy S7 Galaxy S7 Edge What's New", http://web.archive.org/web/20160225121336/http:/www.displaymate.com/Galaxy_S7_ShootOut_1.htm, Published on: Feb. 25, 2016, 11 pages.

"How to custom calibrate the "e;AUTO"e; brightness, or gesture 100% brightness?", http://forums.androidcentral.com/samsung-galaxy-s3/215594-how-custom-calibrate-auto-brightness-gesture-100-brightness.html, Published on: Oct. 10, 2012, 4 pages.

Lee, Joel, "4 Apps to Manage Brightness and Save Your Eyes on Android", http://www.makeuseof.com/tag/4-apps-to-manage-brightness-and-save-your-eyes-on-android/, Published on: Jun. 4, 2013, 6 pages.

"Adjust the display settings on your iPhone, iPad, or iPod touch", https://support.apple.com/en-us/HT202613, Published on: Sep. 13, 2016, 4 pages.

Albadawi, et al., U.S. Appl. No. 15/092,301, "Display Brightness Updating", filed Apr. 4, 2016. 50 pages.

* cited by examiner

CROWD-SOURCED BRIGHTNESS FOR A DISPLAY

BACKGROUND

Computing devices with displays may use a light sensor to trigger an adjustment of the brightness of the display. Users also may manually control the display brightness.

SUMMARY

Computing devices and methods for adjusting the light output of a display in a user computing device are disclosed. In one example, a plurality of user-adjusted brightness settings is received from a plurality of computing devices. For each of the user-adjusted brightness settings, a corresponding environment brightness level is also received, with each such environment brightness level determined contemporaneously with an execution of the user-adjusted brightness setting.

Using the plurality of user-adjusted brightness settings and the corresponding environment brightness levels, at least one crowd-sourced brightness curve is generated. A trigger event associated with the user computing device is determined to occur. Based at least in part on the occurrence of the trigger event, the at least one crowd-sourced brightness curve is distributed to the user computing device.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Computing devices with displays may be used in a variety of lighting conditions, ranging from darker indoor environments to brighter outdoor environments, such as full sunlight. Some devices may automatically adjust a brightness of the display according to the ambient light levels detected by an ambient light sensor (ALS). In some examples, such automatic adjustment may balance readability of the display, which generally increases with display brightness, with the power draw of the display.

However, such computing devices may be purchased and/or used by a wide variety of users, and such users may have eyesight capabilities and display brightness preferences that also vary. Accordingly, in some situations an algorithm generating automatic brightness level adjustments based on ambient light conditions may output a brightness level that is too dark or too light for a particular user, and may thereby provide a negative user experience.

In some examples where a user enables automatic brightness adjustments, the user also may manually increase or decrease a current automatically-selected brightness level. However, adjusting the brightness level in one lighting condition may undesirably impact the brightness level in other lighting conditions. In other examples a user may forego automatic brightness level adjustments, and may rely solely on manually adjusting the brightness level of the display. However, continually making such manual adjustments can be inconvenient, and may have significant power draw implications when brighter display levels remain active for extended periods.

Additionally and for some users, when utilizing a computing device with a display in a variety of lighting conditions, a desired light output of the display may not linearly match the change in brightness of such conditions. For example, when viewing a display in a dark indoor environment, the user-perceived difference in display luminance between 1 nit and 11 nits (a 10 nit difference) typically is quite noticeable. However, when viewing the same display in a brighter outdoor environment, the user-perceived difference in display luminance between 350 nits and 360 nits (also a 10 nit difference) is much less noticeable.

In this situation, increasing display luminance from 350 nits to 360 nits may not appreciably increase readability of the display. Accordingly, while increasing a display's brightness from 1-11 nits may significantly improve readability for a user in a dark environment, applying the same 10-nit increase from 350-360 nits in a bright environment may not noticeably improve readability.

Figure 1:
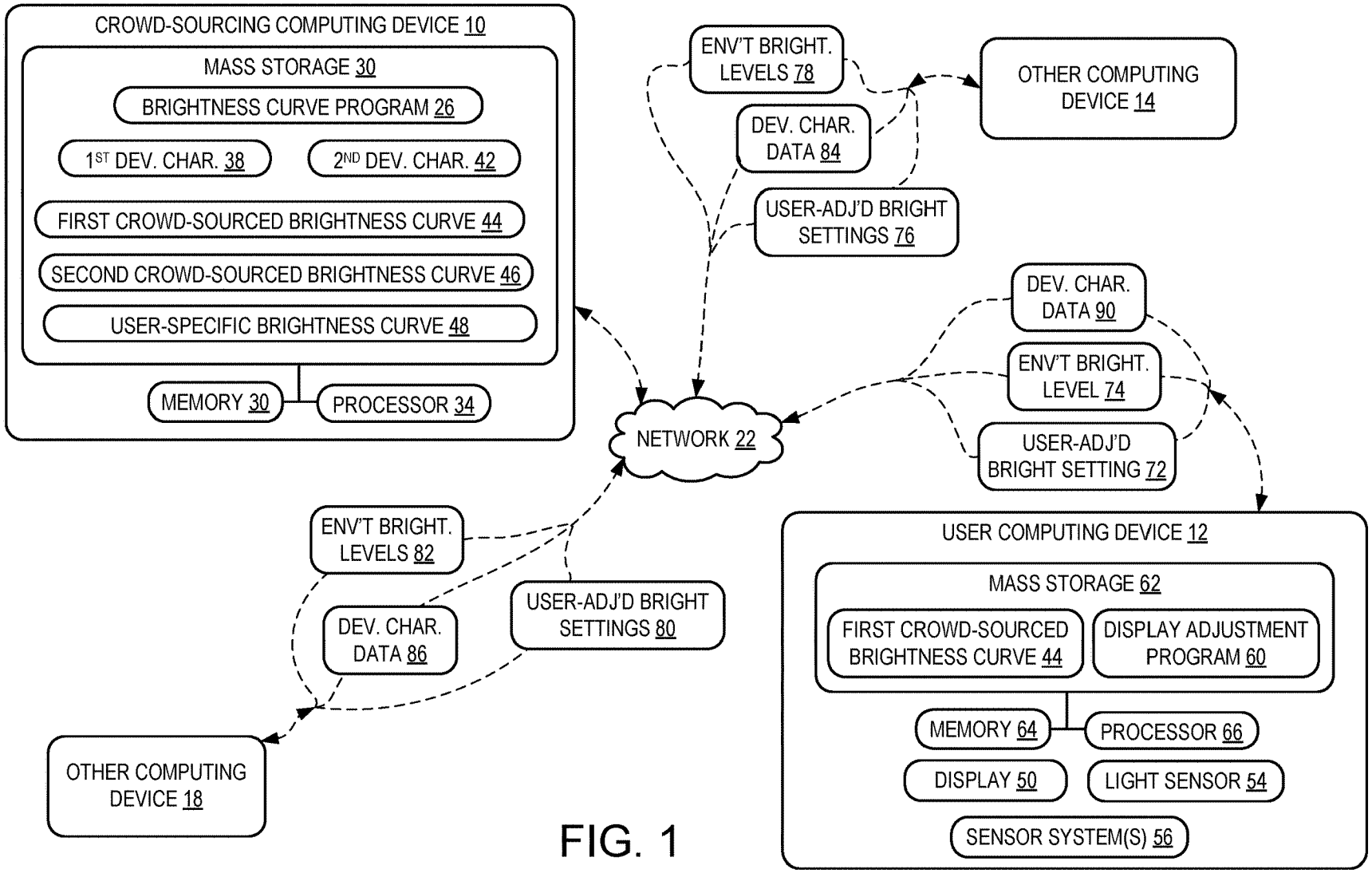
FIG. 1 is a schematic representation of a user computing device, crowd-sourcing computing device and two other computing devices according to examples of the present disclosure.

As described in more detail below, the present disclosure provides computing devices and corresponding methods for generating crowd-sourced brightness curves, and for using such curves to adjust the light output of a display of a user computing device. FIG. 1 illustrates a crowd-sourcing computing device 10 according to examples of the present disclosure. In different examples the crowd-sourcing computing device 10 may take a variety of forms, such as a server computing device, a desktop computing device, and any other suitable form of computing device.

Crowd-sourcing computing device 10 may be communicatively coupled to a plurality of other computing devices, such as user computing device 12 and other computing devices 14, 18. Crowd-sourcing computing device 10 may be communicatively coupled to the other computing devices via a wired connection or a wireless connection to a network 22. In some examples, the network 22 may take the form of a local area network (LAN), wide area network (WAN), wired network, wireless network, personal area network, or a combination thereof, and may include the Internet.

As described in more detail below, crowd-sourcing computing device 10 may include a brightness curve program 26 that may be stored in mass storage 30. Brightness curve program 26 may be loaded into memory 30 and its instructions executed by processor 34 to perform one or more of the methods and processes described herein for generating and distributing crowd-sourced brightness curves that adjust light output of a display in a user computing device. As described in more detail below, data also may be stored in mass storage 30, such first device characteristic 38, second device characteristic 42, first crowd-sourced brightness curve 44, second crowd-sourced brightness curves 46, and user-specific brightness curve 48.

FIG. 1 also illustrates a user computing device 12 according to examples of the present disclosure. In different examples the user computing device 12 may take a variety of forms, such as a smartphone, tablet, or laptop computer, wrist-mounted device, head-mounted display device or other wearable computing device, computerized medical device, such as a computerized pulse oximeter, electronic inhaler, blood pressure monitor, etc.

As schematically shown in FIG. 1, user computing device 12 may comprise a display 50. Display 50 may be any suitable type of display. In some configurations, a thin, low-power light emitting diode (LED) array may be used. In other examples, the display 50 may comprise a liquid crystal display (LCD), such as a capacitive thin-film transistor (TFT) full color display. An LCD array may be backlit in some implementations. A curved or a flat display may be used. In other examples, active-matrix organic light-emitting diode (OLED) displays, AMOLED displays, quantum dot displays, or any other suitable display technology may be used. The display 50 may be a touch-screen display configured to receive touch input from a user, and may be resistive, capacitive, or optically based.

User computing device 12 may comprise one or more light sensors 54 that may generate signals and other data responsive to detecting light. Examples of light sensors may include, for example, ambient light sensors (ALS), ultraviolet (UV) light sensors, RGB light sensors, and other multi-channel light sensors. Light sensor(s) 54 may comprises photoelectric photodetectors, such as active-pixel sensors (APSs), charged-coupled devices (CCDs), or any other suitable photodetector. Using data from the light sensor(s) 54, the user computing device may determine an environment brightness level of a surrounding environment of the device.

In some examples the computing device 10 may comprise one or more additional sensor systems 56 that may generate signals and other data responsive to detecting various inputs. Examples of sensor systems may include, for example, accelerometers, gyroscopes, magnetometers, inertial measurement units (IMU), barometers, ambient temperature sensors, global positioning systems (GPS), microphones, heart rate monitors, galvanic skin response sensors, skin temperature sensors, etc.

The user computing device 12 may comprise a display adjustment program 60 stored in mass storage 62. The display adjustment program 60 may be loaded into memory 64 and its instructions executed by processor 66 to adjust light output of the display 50. In some examples and as described in more detail below, the display adjustment program 60 may adjust the light output of the display 50 to an adjusted brightness by mapping an ambient light level determined from the light sensor 54 to a crowd-sourced brightness curve, such as first crowd-sourced brightness curve 44, to thereby determine the adjusted brightness level. User computing device 12 may receive crowd-sourced brightness curves from crowd-sourcing computing device 10 via network 22.

In other examples, the display adjustment program 60 may adjust light output of the display 50 via user input received from a user of the device, such via as touch interactions with a brightness adjustment user interface presented on display 50. For example, a current display brightness may be based on a first crowd-sourced brightness curve 44 and a current environment brightness level as detected by the light sensor 54. A user may adjust light output of the display 50 by manually adjusting the current display brightness to a user-adjusted brightness setting 72. Additionally and as described in more detail below, such user-adjusted brightness setting 72 and the corresponding environment brightness level 74 that is determined contemporaneously with the execution of the user-adjusted brightness setting may be provided to the crowd-sourcing computing device 10 for use in generating crowd-sourced brightness curves.

In some examples, crowd-sourcing computing device 10 may receive from each of a plurality of computing devices user-adjusted brightness settings and corresponding environment brightness levels determined contemporaneously with the execution of the user-adjusted brightness settings. In the example of FIG. 1, crowd-sourcing computing device 10 receives user-adjusted brightness settings 76 and corresponding, contemporaneous environment brightness levels 78 from other computing device 14. Similarly, crowd-sourcing computing device 10 receives user-adjusted brightness settings 80 and corresponding, contemporaneous environment brightness levels 82 from other computing device 18. In other examples, crowd-sourcing computing device 10 may receive additional user-adjusted brightness settings and corresponding, contemporaneous environment brightness levels from additional computing devices.

Figure 2:
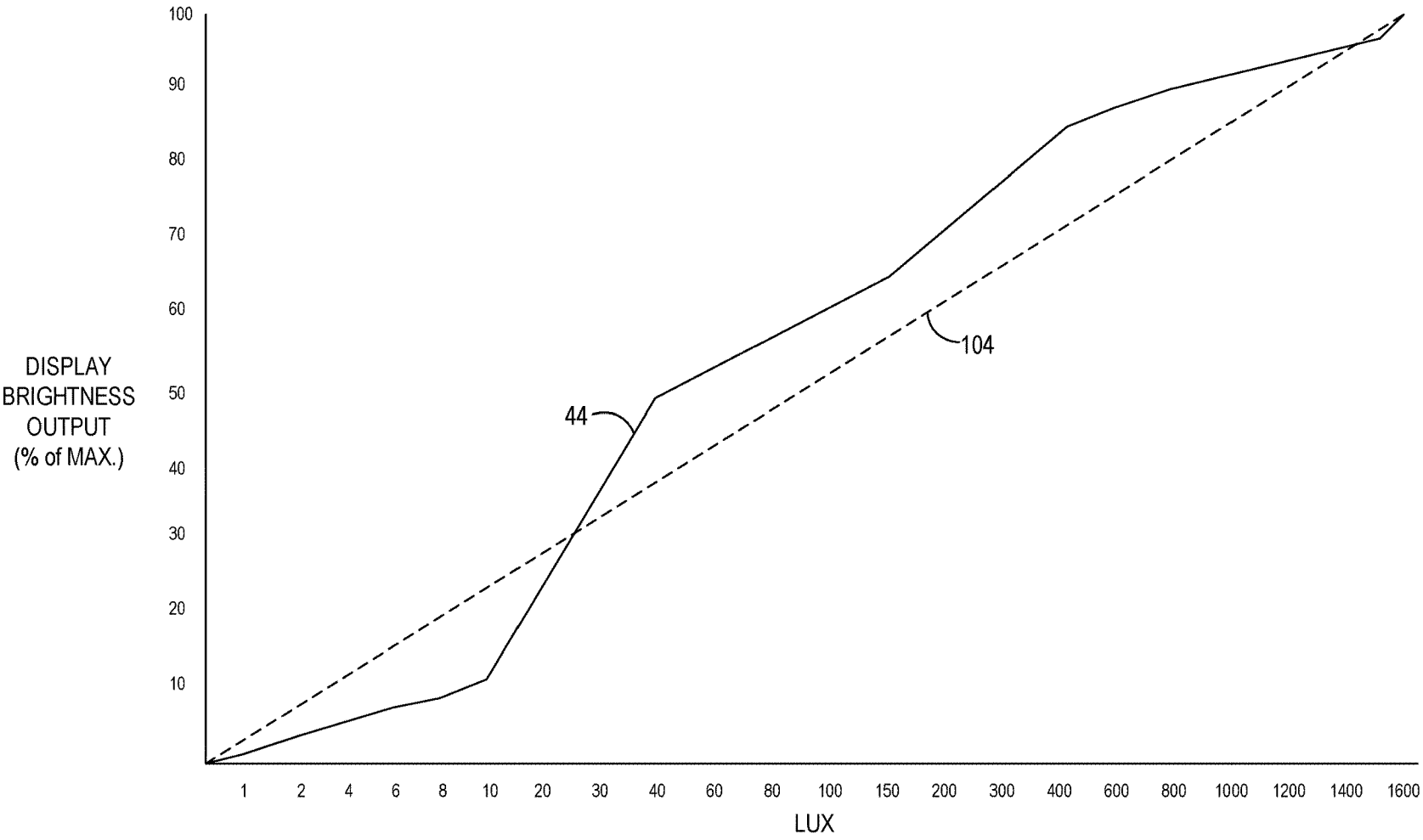
FIG. 2 shows a first crowd-sourced brightness curve and a default brightness curve according to examples of the present disclosure.

Brightness curve program 26 in crowd-sourcing computing device 10 may utilize user-adjusted brightness settings and corresponding, contemporaneous environment brightness levels received from user computing device, other computing device 14 and/or other computing device 18 to generate one or more crowd-sourced brightness curves. With reference now to FIG. 2, an example of first crowd-sourced brightness curve 44 is illustrated. In this example, first crowd-sourced brightness curve 44 plots a display brightness output with a corresponding lux value of an environment brightness level. For example, at a detected environment brightness level of 40 lux, the display brightness output is approximately 51% of its maximum brightness. In one example of a display, 51% of the display's maximum brightness corresponds to approximately 205 nits (cd/m$^2$).

In other examples, the display brightness output may be expressed as a backlight percentage (for displays utilizing a backlight) or other translation methodology that represents the brightness output of a display. In some examples, a crowd-sourced brightness curve may be expressed as a collection of value pairs of display brightness outputs and corresponding environment brightness levels. In these examples, a lookup table populated with such value pairs may comprise a brightness curve.

In some examples, the generation of first crowd-sourced brightness curve 44 may begin with a default brightness curve that approximates or estimates a user-desired display brightness output for a range of environment brightness levels. In one example and with continued reference to FIG. 2, the default brightness curve may be a straight line 104 extending from the origin to the point at 100% display brightness output and 1600 lux environment brightness level. With reference again to FIG. 1, the default brightness curve may be subsequently modified utilizing different combinations of the user-adjusted brightness settings and corresponding, contemporaneous environment brightness levels received from user computing device 12, other computing device 14 and/or other computing device 18. In this manner, first crowd-sourced brightness curve 44 may be generated.

Example use cases illustrating aspects of the present disclosure will now be presented. In one example and with reference to FIG. 1, a user may purchase user computing device 12 in the form of a new smartphone. The smartphone may be preloaded with a standard brightness curve that is used to adjust the display brightness as a function of the current environment brightness level. In this example, the crowd-sourcing computing device 10 may comprise a multi-tenant identity management service. The user may have an existing account at the identity management service or she may establish a new account with the service via her new smartphone.

In some examples, when the user signs into her account at the crowd-sourcing computing device 10 using her new smartphone, the crowd-sourcing computing device is triggered to distribute the first crowd-sourced brightness curve 44 to the new smartphone. In other words, the crowd-sourcing computing device 10 determines that a trigger event has occurred (i.e., the user signing into her account), and in response sends the first crowd-sourced brightness curve 44 to the new smartphone. Accordingly and in these examples, based at least in part on the user signing into her account, the crowd-sourcing computing device 10 distributes the first crowd-sourced brightness curve 44 to the new smartphone. In this manner, the default brightness curve may be updated with the first crowd-sourced brightness curve 44. The new smartphone may then utilize the first crowd-sourced brightness curve 44 to adjust the display brightness as a function of a current environment brightness level.

In other examples, a variety of other trigger events associated with user computing device 12 may cause the crowd-sourcing computing device 10 to distribute a crowd-sourced brightness curve to the user computing device. For example, when user computing device 12 requests or otherwise receives an operating system update from crowd-sourcing computing device 10, an updated crowd-sourced brightness curve also may be distributed to the user computing device. In some examples, a trigger event may comprise a temporal trigger that is associated with user computing device 12. The temporal trigger may comprise a predetermined or user-selected frequency for requesting an updated crowd-sourced brightness curve, such as daily, weekly, monthly, etc.

As noted above, the first crowd-sourced brightness curve 44 may be generated using a plurality of user-adjusted brightness settings and corresponding, contemporaneous environment brightness levels from a plurality of computing devices. Accordingly, in these examples the first crowd-sourced brightness curve 44 may provide the new smartphone user with various display brightness settings across a range of ambient lighting conditions that provide a more pleasing user experience as compared to the default or other previously-used display brightness curve.

In some examples, the first crowd-sourced brightness curve 44 that is distributed to the user computing device 12 may be generated using user-adjusted brightness settings and corresponding, contemporaneous environment brightness levels received from computing devices other than the new smartphone. For example, the first time the user signs into her account at the crowd-sourcing computing device 10 using her newly-acquired smartphone, the smartphone previously may not have provided any user-adjusted brightness settings or corresponding, contemporaneous environment brightness levels to the crowd-sourcing computing device 10. Accordingly, in this example the first crowd-sourced brightness curve 44 distributed to the new smartphone will have been generated using solely user-adjusted brightness settings and corresponding, contemporaneous environment brightness levels received from computing devices other than the new smartphone.

In other examples, over time the new smartphone may provide user-adjusted brightness settings 72 and corresponding, contemporaneous environment brightness levels 74 to the crowd-sourcing computing device 10. In these examples, the crowd-sourcing computing device 10 may use the user-adjusted brightness settings 72 and corresponding, contemporaneous environment brightness levels 74 along with other user-adjusted brightness settings and corresponding, contemporaneous environment brightness levels from other computing devices to generate one or move crowd-sourced brightness curve(s) that may be periodically distributed to the new smartphone.

In some examples, the crowd-sourcing computing device 10 may receive device characteristic data that identifies one or more device characteristic(s) of the computing devices that are providing user-adjusted brightness settings and corresponding, contemporaneous environment brightness levels. Such device characteristic data may be contained in metadata that is sent with a user-adjusted brightness setting and/or corresponding, contemporaneous environment brightness level. In some examples, such metadata may be separately provided by the computing devices to the crowd-sourcing computing device 10. In the example of FIG. 1, other computing device 14 sends device characteristic data 84 to crowd-sourcing computing device 10, other computing device 18 sends device characteristic data 86 to the crowd-sourcing computing device, and user computing device 12 sends device characteristic data 90 to the crowd-sourcing computing device.

In these examples, the brightness curve program 26 may use such device characteristic data to generate different crowd-sourced brightness curves that are associated with one or more device characteristics. For example, the first crowd-sourced brightness curve 44 may be generated using user-adjusted brightness settings and corresponding, contemporaneous environment brightness levels received solely from computing devices of a particular device type. Examples of device types include smartphones, tablets, laptops, head-mounted display devices, etc. In some examples, device characteristic data may additionally or alternatively specify a particular manufacturer, model, series, version, generation, and/or other grouping of a device type.

With reference again to FIG. 1, in one example the crowd-sourcing computing device 10 may generate the first crowd-sourced brightness curve 44 from user-adjusted brightness settings and corresponding, contemporaneous environment brightness levels received solely from Model Awesome smartphone computing devices, such as other computing device 18 as well as additional other Model Awesome smartphones (not shown). In this example the crowd-sourcing computing device 10 may receive device characteristic data 90 from user computing device 12 that identifies this user computing device as a Model Awesome smartphone. Accordingly, and based at least in part on identifying the user computing device 12 as a Model Awesome smartphone, the crowd-sourcing computing device 10 may distribute the first crowd-sourced brightness curve 44 to the user computing device 12. In this manner, user computing device 12 receives a crowd-sourced brightness curve that is customized for its device type.

In a similar manner, a variety of other device characteristics of computing devices may be received by crowd-sourcing computing device 10, and may be utilized to generate corresponding crowd-sourced brightness curves for computing devices comprising one or more particular device characteristic(s). In some examples, the device characteristic may comprise a size of the display of the computing device. The display size may be expressed as an area of the display, such as 70 square centimeters. For example, different crowd-sourced brightness curves may be generated for different discrete display sizes and/or for different ranges of display sizes.

In other examples, the device characteristic may comprise a resolution of the display of the computing device. The resolution may be expressed as a pixel density (such as 1334×750 pixels or 326 pixels per square inch) or as a range of pixel densities.

In some examples the device characteristic may comprise a reflectance of the display of the computing device. An example of a display reflectance is a general screen reflectance, such as a percentage of ambient light from all directions reflected by the display screen. Another example of display reflectance is a specular or mirror reflectance, such as a percentage of collimated light reflected by the display screen. Such a device characteristic may be expressed as a discrete display reflectance percentage or a range of display reflectance percentages.

In some examples the device characteristic may comprise a range of display brightness output levels of the display of the computing device. For example, the device characteristic may comprise a minimum display brightness output level and a maximum display brightness output level. In one example, a minimum display brightness output level may be 3 nits, and a maximum display brightness output level may be 400 nits.

In different examples, different crowd-sourced brightness curves may be generated and distributed based on different device characteristics. In some examples, two or more different device characteristics may be utilized to generate a single crowd-sourced brightness curve that is associated with the two or more different device characteristics.

In some examples, the crowd-sourcing computing device 10 may receive device context data that identifies a context of the computing devices when user-adjusted brightness settings and corresponding, contemporaneous environment brightness levels are provided. Such device context data may be contained in metadata that is sent with a user-adjusted brightness setting and/or corresponding, contemporaneous environment brightness level. In some examples, such metadata may be separately provided by the computing devices to the crowd-sourcing computing device 10.

In one example, device context data may comprise velocity and/or acceleration data that identifies whether the computing device is in motion or is stationary. For example, a user may prefer a brighter display when looking at the device while walking as compared to using the device when standing still or seated. In one example where the user is walking, the user may adjust the display brightness to a higher brightness setting. In addition to the user-adjusted brightness setting and the corresponding, contemporaneous environment brightness level, accelerometer data may be sent to the crowd-sourcing computing device 10 indicating that the computing device is in motion when the user-adjusted brightness setting is made.

In another example where the user is sitting on her sofa at home, the user may adjust the display brightness to a lower brightness setting. In addition to the user-adjusted brightness setting and the corresponding, contemporaneous environment brightness level, accelerometer data may be sent to the crowd-sourcing computing device 10 indicating that the device is not in motion when the user-adjusted brightness setting is made.

In these examples, the brightness curve program 26 may use such device context data to generate different crowd-sourced brightness curves that are associated with a particular device context. For example, a first crowd-sourced brightness curve may be generated using user-adjusted brightness settings and corresponding, contemporaneous environment brightness levels received solely from computing devices in motion when such settings were made. Similarly, a second crowd-sourced brightness curve may be generated using user-adjusted brightness settings and corresponding, contemporaneous environment brightness levels received solely from computing devices that were stationary when such settings were made. In some examples, a device may be deemed stationary when its acceleration is below a predetermined threshold.

In other examples, other types or forms of device context data may be utilized in a similar manner to generate crowd-sourced brightness curves. For example, different crowd-sourced brightness curves may be generated based on a location of the computing devices (e.g., at the user's home vs. at the user's office) by receiving GPS data captured when a user-adjusted brightness setting is made.

As noted above, in some examples where a user computing device is utilizing a crowd-sourced brightness curve to adjust display brightness, a user may manually adjust a brightness level of a computing device display to a user-adjusted brightness setting. In some examples, such user-adjusted brightness settings and their corresponding, contemporaneously-determined environment brightness levels may be utilized by the user computing device and/or the crowd-sourcing computing device to customize a crowd-sourced brightness curve into a user-specific brightness curve.

Figure 3:
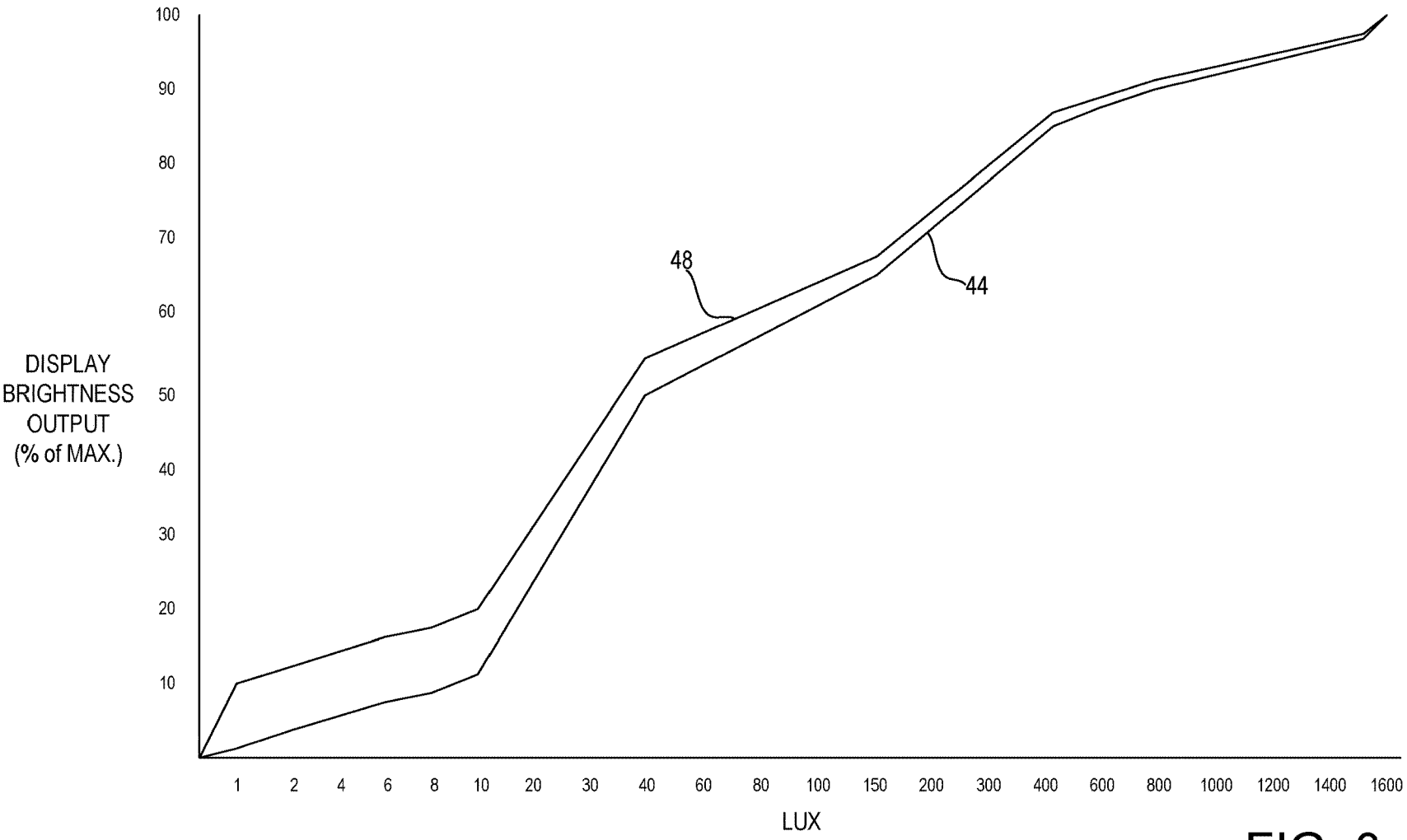
FIG. 3 shows the first crowd-sourced brightness curve of FIG. 2 and a user-specific brightness curve according to examples of the present disclosure.

As the user provides more user-adjusted brightness settings at different environment brightness levels, the crowd-sourced brightness curve may be further modified into the user-specific brightness curve. As an example, FIG. 3 illustrates the first crowd-sourced brightness curve 44 of FIG. 2, and a user-specific brightness curve 48 generated by modifying the first crowd-sourced brightness curve with user-adjusted brightness settings and their corresponding, contemporaneously-determined environment brightness levels from the user computing device 12.

For example, user computing device 12 may use first crowd-sourced brightness curve 44 to set the display brightness based on a current environment brightness level. At an environment brightness level of 40 lux, the first crowd-sourced display brightness curve 44 sets the display brightness output to approximately 51% of its maximum brightness. However, the user of user computing device 12 may find this display brightness in this lighting condition to be less than optimal. Accordingly, the user may increase the display brightness output to a user-adjusted brightness setting of approximately 54% as shown in user-specific brightness curve 48. Using this and other user-adjusted brightness settings and their corresponding, contemporaneously-determined environment brightness levels, the user-specific brightness curve 48 may be generated.

In some examples, a first user-specific brightness curve for a first user computing device may be modified to generate a second user-specific brightness curve for a different user computing device. Such modifications may be based on a crowd-sourced brightness curve for the first user computing device and on a crowd-sourced brightness curve for the different user computing device. In this manner, the second user-specific brightness curve for the different user computing device may be generated based on the user's display brightness preferences across a range of lighting conditions for the first user computing device.

In one example, a user Max may own a prior user computing device that comprises a first device characteristic, such as a device type. For example, the prior user computing device may be a Model Awesome smartphone. The prior user computing device may utilize a crowd-sourced brightness curve, such as the first crowd-sourced brightness curve 44 shown in FIG. 3, that is associated with Model Awesome smartphones. As described above, Max may periodically adjust the display brightness, and such user-adjusted brightness settings and their corresponding, contemporaneously-determined environment brightness levels may be used to customize the first crowd-sourced brightness curve 44 into a user-specific brightness curve 48 for Max's Model Awesome smartphone.

Other Model Awesome smartphones owned and/or used by other users also may utilize the first crowd-sourced brightness curve 44. Some of these users also may own and/or use another, different computing device that is associated with a second device characteristic. For example, these users also may own and/or use a Model Fantastic laptop computer.

Figure 4:
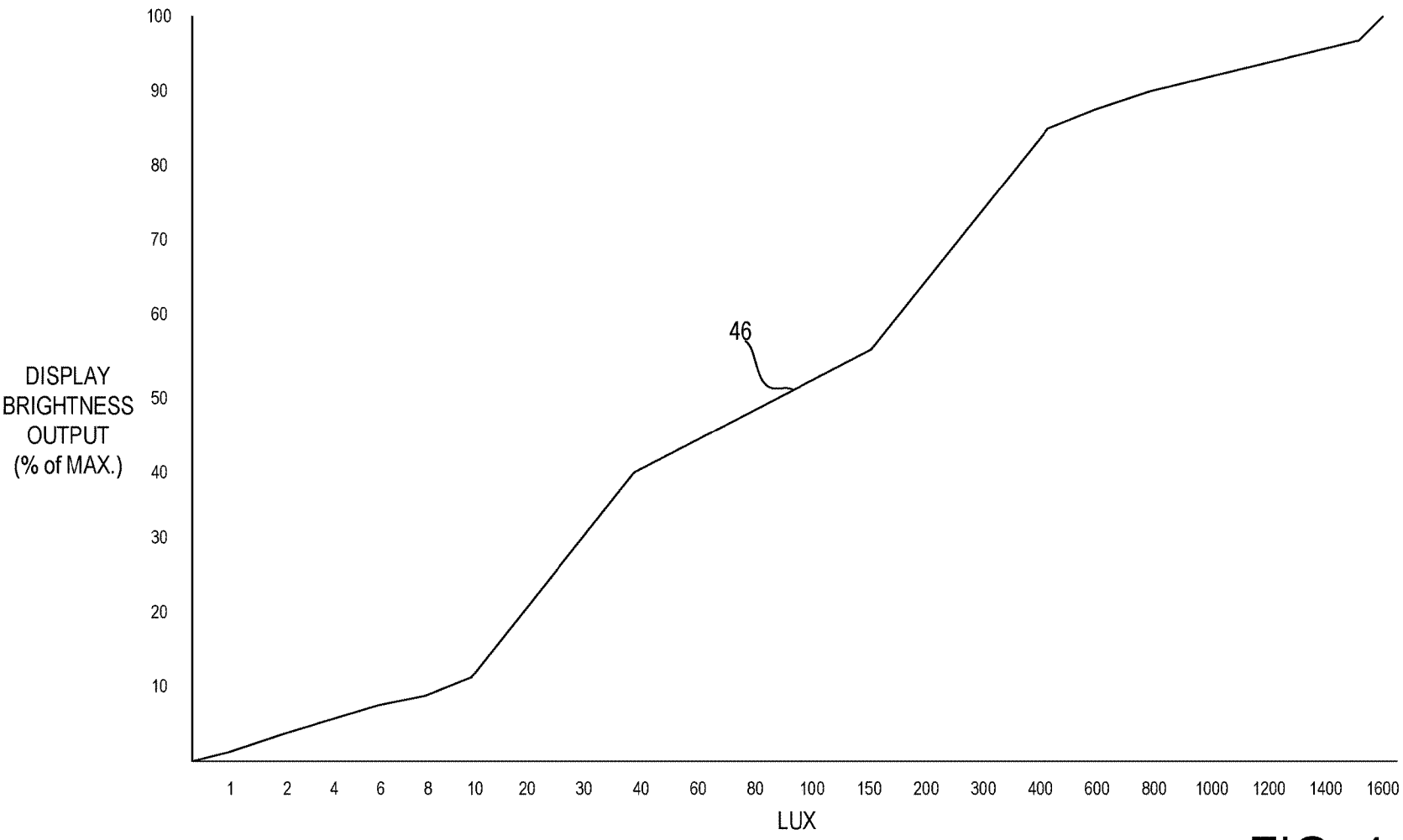
FIG. 4 shows a second crowd-sourced brightness curve according to examples of the present disclosure.

These users also may manually adjust the brightness level of their Model Fantastic laptops under different environment lighting conditions to different user-adjusted brightness settings. Such user-adjusted brightness settings and their corresponding, contemporaneous environment brightness levels may be utilized by crowd-sourcing computing device 10 to generate a second crowd-sourced brightness curve 46 associated with Model Fantastic laptops. An example of second crowd-sourced brightness curve 46 is illustrated in FIG. 4.

Subsequently, user Max may purchase or otherwise begin using a Model Fantastic laptop. User Max may register his Model Fantastic laptop and/or otherwise communicate with the crowd-sourcing computing device 10. As described in more detail below, the brightness curve program 26 may generate a modified version of Max's user-specific brightness curve 48 for Max's Model Awesome smartphone (for use with Max's Model Fantastic laptop) based on a difference between the first crowd-sourced brightness curve 44 (associated with the Model Awesome smartphone) and the second crowd-sourced brightness curve 46 (associated with the Model Fantastic laptop).

For example, the brightness curve program 26 may identify the user-specific brightness curve 48 for Max's Model Awesome smartphone. As indicated above, the brightness curve program 26 also may receive data indicating that user Max has purchased or is now using a Model Fantastic laptop. The brightness curve program 26 may identify a subset of other users who own and/or use both a Model Fantastic laptop and a Model Awesome smartphone. By comparing the first crowd-sourced brightness curve 44 (associated with the Model Awesome smartphone) with the second crowd-sourced brightness curve 46 (associated with the Model Fantastic laptop), the brightness curve program 26 may generate a weighted value based on the difference between the two curves.

In one example, such a comparison may reveal that users of the Model Fantastic laptop prefer a display brightness output that is approximately 10% higher, on average, for a given environment brightness level as compared to the preferred display brightness output at corresponding environment brightness levels for their Model Awesome smartphones. Accordingly, in this example the weighted value may be determined to be 1.1.

Having determined the weighted value based on the difference between the two curves, the brightness curve program 26 may modify the user-specific brightness curve 48 for Max's Model Awesome smartphone using the weighted value of 1.1 to generate a modified user-specific brightness curve that increases the display brightness output by approximately 10% for a given environment brightness level as compared to the user-specific brightness curve 48. The crowd-sourcing computing device 10 may distribute this modified user-specific brightness curve to Max's Model Fantastic laptop for use in adjusting display brightness levels.

In this manner, information gleaned from Max's user-specific brightness curve 48 for his Model Awesome smartphone along with the first and second crowd-sourced brightness curves 44, 48 may be leveraged to generate a user-specific brightness curve for Max's new Model Fantastic laptop that reflects Max's actual display brightness preferences, as well as other users' display brightness preferences for the same devices. In other examples, other user-specific brightness curves may be generated in a similar manner using other device characteristic data and various combinations of such data.

In some examples, a crowd-sourced brightness curve also may increase the readability of a display by modifying a gamma ramp based on data from a light sensor, such as lux values from an ambient light sensor or RGB values from an RGB light sensor. In these examples, a subjective brightness as perceived by a user may be increased by manipulating a gamma correction operation using such data captured by a light sensor of a user computing device.

In some examples, a crowd-sourced brightness curve also may be generated based on the colors of the pixels on the display when a user-adjusted brightness setting is made. In one example of a backlighted display, the perceived display brightness may increase as the number of white pixels increases as compared to the number of black pixels. Accordingly, in some examples the relative numbers of white and black pixels may be determined when a user-adjusted brightness setting is made, and such data may be sent to a crowd-sourcing computing device for use in generating a crowd-sourced brightness curve.

Figure 5A:
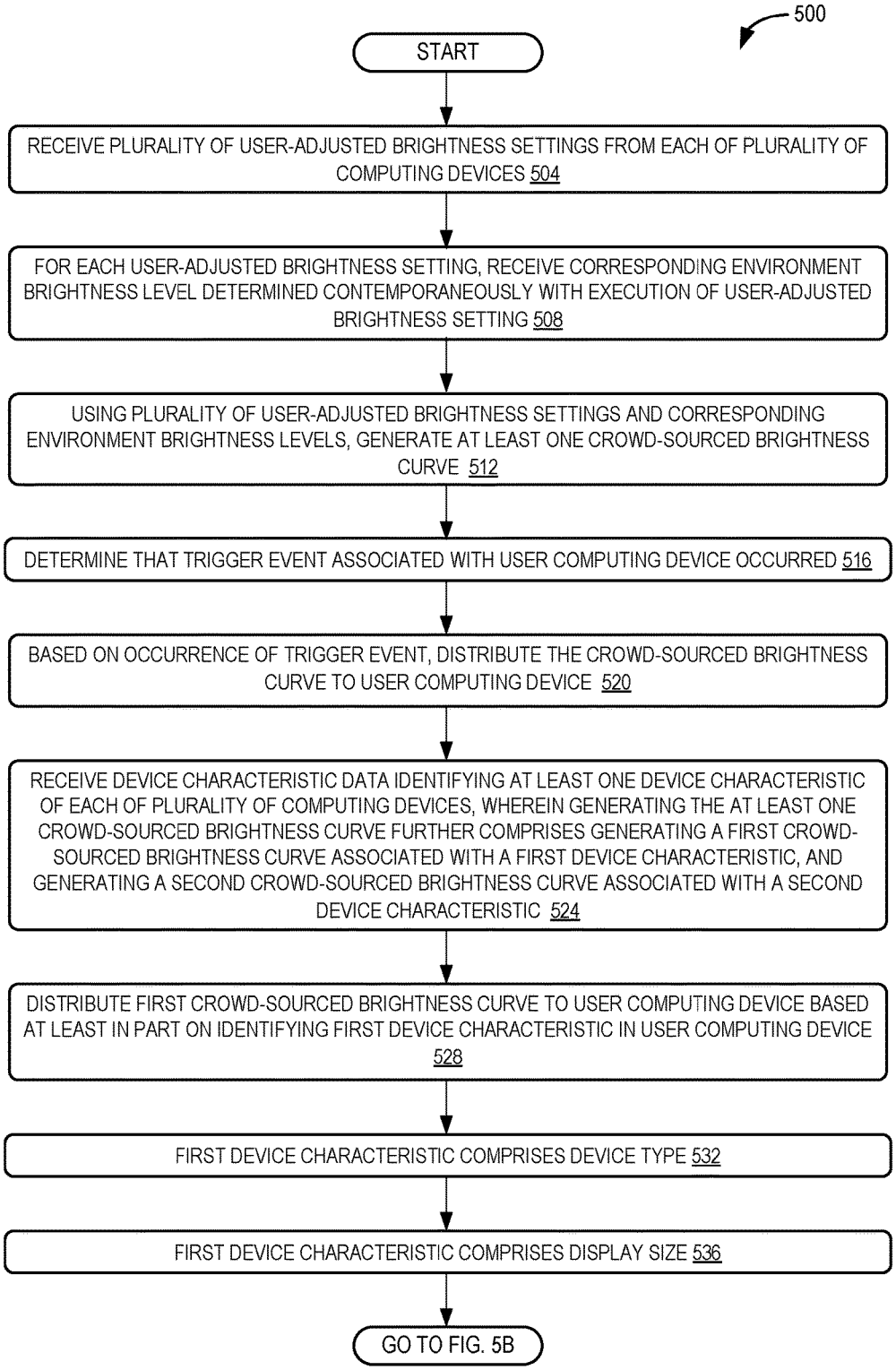
FIGS. 5A and 5B show a method for adjusting light output of a display in a user computing device according to examples of the present disclosure.
Figure 5B:
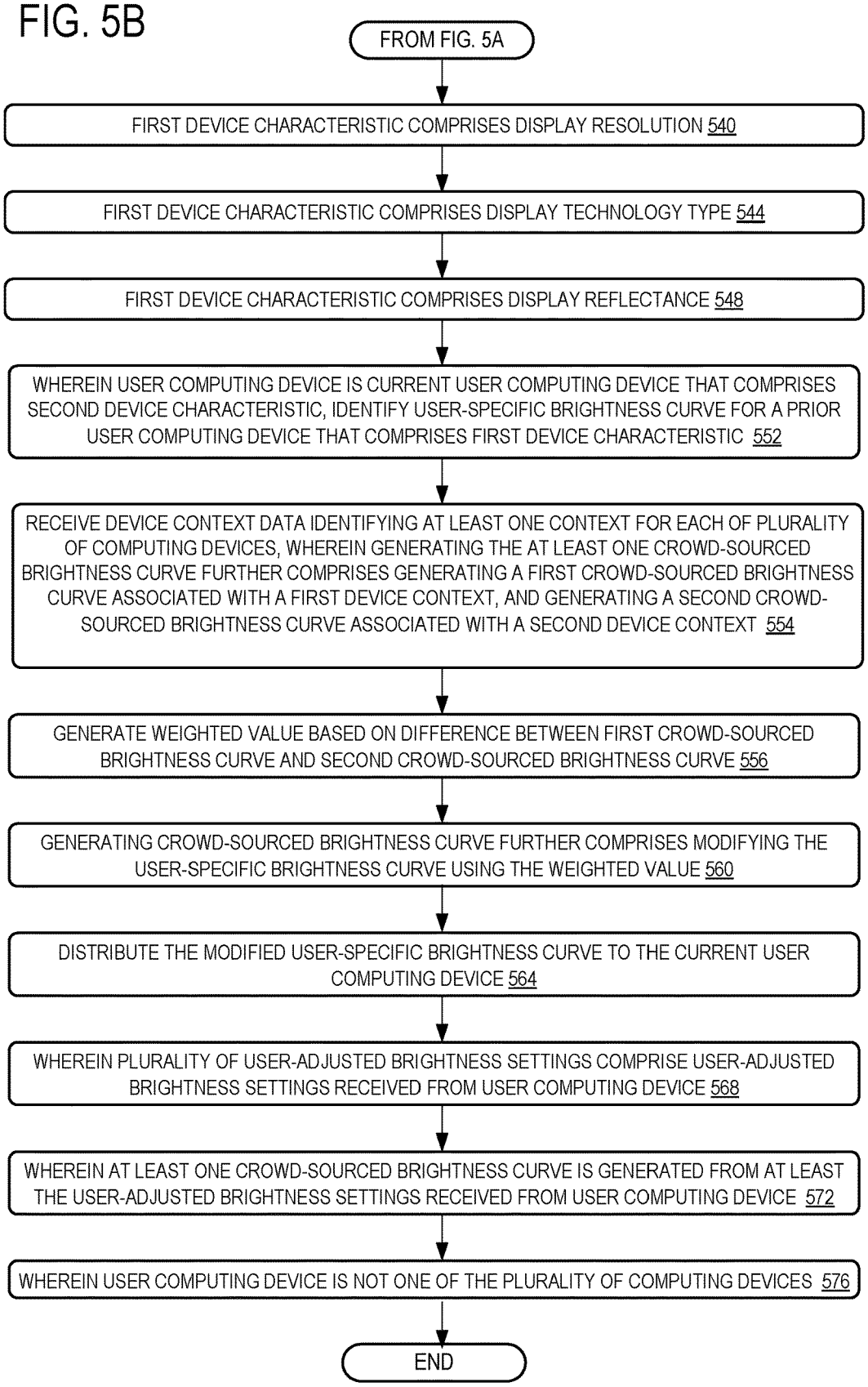

FIGS. 5A and 5B illustrate a flow chart of a method 500 for controlling light output of a display in a computing device according to examples of the present disclosure. The following description of method 500 is provided with reference to the software and hardware components described above and shown in FIGS. 1-4. It will be appreciated that method 500 also may be performed in other contexts using other suitable hardware and software components.

With reference to FIG. 5A, at 504 the method 500 may include receiving a plurality of user-adjusted brightness settings from each of a plurality of computing devices. At 508 the method 500 may include, for each of the user-adjusted brightness settings, receiving a corresponding environment brightness level that is determined contemporaneously with an execution of the user-adjusted brightness setting. At 512 the method 500 may include, using the plurality of user-adjusted brightness settings and the corresponding environment brightness levels, generating at least one crowd-sourced brightness curve.

At 516 the method 500 may include determining that a trigger event associated with the user computing device has occurred. At 520 the method 500 may include, based at least in part on the occurrence of the trigger event, distributing the at least one crowd-sourced brightness curve to the user computing device. At 524 the method 500 may include receiving device characteristic data identifying at least one device characteristic of each of the plurality of computing devices, and wherein generating the at least one crowd-sourced brightness curve further comprises generating a first crowd-sourced brightness curve associated with a first device characteristic, and generating a second crowd-sourced brightness curve associated with a second device characteristic. At 528 the method 500 may include, wherein distributing the at least one crowd-sourced brightness curve to the user computing device further comprises distributing the first crowd-sourced brightness curve based at least in part on identifying the first device characteristic in the user computing device.

At 532 the method 500 may include, wherein the first device characteristic comprises a device type. At 536 the method 500 may include, wherein the first device characteristic comprises a size of the display. With reference now to FIG. 5B, at 540 the method 500 may include, wherein the first device characteristic comprises a resolution of the display. At 544 the method 500 may include, wherein the first device characteristic comprises a technology type of the display. At 548 the method 500 may include, wherein the first device characteristic comprises a reflectance of the display.

At 552 the method 500 may include, wherein the user computing device is a current user computing device that comprises the second device characteristic, identifying a user-specific brightness curve for a prior user computing device that comprises the first device characteristic. At 554 the method 500 may include receiving device context data identifying at least one context for each of the plurality of computing devices, and wherein generating the at least one crowd-sourced brightness curve further comprises generating a first crowd-sourced brightness curve associated with a first device context, and generating a second crowd-sourced brightness curve associated with a second device context. At 556 the method 500 may include generating a weighted value based on a difference between the first crowd-sourced brightness curve and the second crowd-sourced brightness curve.

At 560 the method 500 may include, wherein generating the at least one crowd-sourced brightness curve further comprises modifying the user-specific brightness curve using the weighted value. At 564 the method 500 may include, wherein distributing the at least one crowd-sourced brightness curve further comprises distributing the modified user-specific brightness curve to the current user computing device.

At 568 the method 500 may include, wherein the plurality of user-adjusted brightness settings comprises a plurality of user-adjusted brightness settings received from the user computing device. At 572 the method 500 may include, wherein the at least one crowd-sourced brightness curve is generated from at least the plurality of user-adjusted brightness settings received from the user computing device. At 576 the method 500 may include, wherein the user computing device is not one of the plurality of computing devices.

It will be appreciated that method 500 is provided by way of example and is not meant to be limiting. Therefore, it is to be understood that method 500 may include additional and/or alternative steps relative to those illustrated in FIGS. 5A and 5B. Further, it is to be understood that method 500 may be performed in any suitable order. Further still, it is to be understood that one or more steps may be omitted from method 500 without departing from the scope of this disclosure.

In some embodiments, the methods and processes described herein may be tied to a computing system of one or more computing devices. In particular, such methods and processes may be implemented as a computer-application program or service, an application-programming interface (API), a library, and/or other computer-program product.

Figure 6:
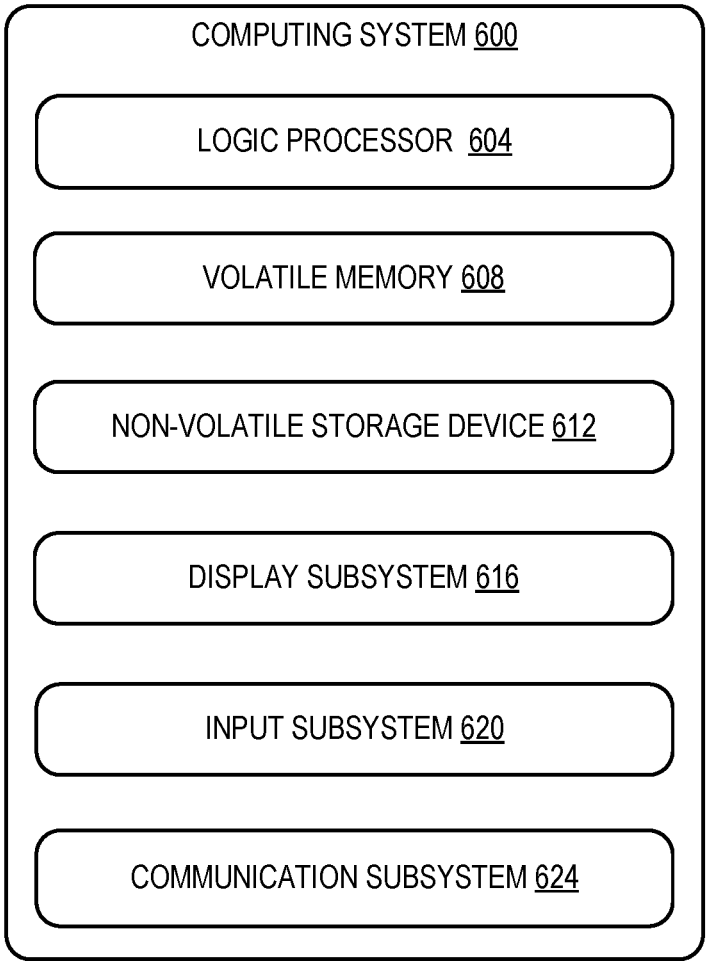
FIG. 6 schematically shows a computing system according to examples of the present disclosure.

FIG. 6 schematically shows a non-limiting embodiment of a computing system 600 that can enact one or more of the methods and processes described above. Computing system 600 is shown in simplified form. Crowd-sourcing computing device 10, user computing device 12, and other computing devices 14, 18 shown in FIG. 1 may take the form of computing system 600.

Computing system 600 includes a logic processor 604, volatile memory 608, and a non-volatile storage device 612. Computing system 600 may optionally include a display subsystem 616, input subsystem 620, communication subsystem 624, and/or other components not shown in FIG. 6.

Logic processor 604 includes one or more physical devices configured to execute instructions. For example, the logic processor may be configured to execute instructions that are part of one or more applications, programs, routines, libraries, objects, components, data structures, or other logical constructs. Such instructions may be implemented to perform a task, implement a data type, transform the state of one or more components, achieve a technical effect, or otherwise arrive at a desired result.

The logic processor 604 may include one or more physical processors (hardware) configured to execute software instructions. Additionally or alternatively, the logic processor may include one or more hardware logic circuits or firmware devices configured to execute hardware-implemented logic or firmware instructions. Processors of the logic processor 604 may be single-core or multi-core, and the instructions executed thereon may be configured for sequential, parallel, and/or distributed processing. Individual components of the logic processor optionally may be distributed among two or more separate devices, which may be remotely located and/or configured for coordinated processing. Aspects of the logic processor 604 may be virtualized and executed by remotely accessible, networked computing devices configured in a cloud-computing configuration. In such a case, these virtualized aspects may be run on different physical logic processors of various different machines.

Volatile memory 608 may include physical devices that include random access memory. Volatile memory 608 is typically utilized by logic processor 604 to temporarily store information during processing of software instructions. It will be appreciated that volatile memory 608 typically does not continue to store instructions when power is cut to the volatile memory.

Non-volatile storage device 612 includes one or more physical devices configured to hold instructions executable by the logic processors to implement the methods and processes described herein. When such methods and processes are implemented, the state of non-volatile storage device 612 may be transformed—e.g., to hold different data.

Non-volatile storage device 612 may include physical devices that are removable and/or built-in. Non-volatile storage device 612 may include optical memory (CD, DVD, HD-DVD, Blu-Ray Disc, etc.), semiconductor memory (ROM, EPROM, EEPROM, FLASH memory, etc.), and/or magnetic memory (hard-disk drive, floppy-disk drive, tape drive, MRAM, etc.), or other mass storage device technology. Non-volatile storage device 612 may include nonvolatile, dynamic, static, read/write, read-only, sequential-access, location-addressable, file-addressable, and/or content-addressable devices. It will be appreciated that non-volatile storage device 612 is configured to hold instructions even when power is cut to the non-volatile storage device.

Aspects of logic processor 604, volatile memory 608, and non-volatile storage device 612 may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

The term "program" may be used to describe an aspect of computing system 600 implemented to perform a particular function. In some cases, a program may be instantiated via logic processor 604 executing instructions held by non-volatile storage device 612, using portions of volatile memory 608. It will be understood that different programs may be instantiated from the same application, service, code block, object, library, routine, API, function, etc. Likewise, the same program may be instantiated by different applications, services, code blocks, objects, routines, APIs, functions, etc. The term "program" encompasses individual or groups of executable files, data files, libraries, drivers, scripts, database records, etc.

When included, display subsystem 616 may be used to present a visual representation of data held by non-volatile storage device 612. As the herein described methods and processes change the data held by the non-volatile storage device, and thus transform the state of the non-volatile storage device, the state of display subsystem 616 may likewise be transformed to visually represent changes in the underlying data. Display subsystem 616 may include one or more display devices utilizing virtually any type of technology. Such display devices may be combined with logic processor 604, volatile memory 608, and/or non-volatile storage device 612 in a shared enclosure, or such display devices may be peripheral display devices.

When included, input subsystem 620 may comprise or interface with one or more user-input devices. In some embodiments, the input subsystem may comprise or interface with selected natural user input (NUI) componentry. Such componentry may be integrated or peripheral, and the transduction and/or processing of input actions may be handled on- or off-board. Example NUI componentry may include a microphone for speech and/or voice recognition; an infrared, color, stereoscopic, and/or depth camera for machine vision and/or gesture recognition; a head tracker, eye tracker, accelerometer, and/or gyroscope for motion detection, gaze detection, and/or intent recognition; electric-field sensing componentry for assessing brain activity; any of the sensors described above with respect to user computing device 12; and/or any other suitable sensor.

When included, communication subsystem 624 may be configured to communicatively couple computing system 600 with one or more other computing devices. Communication subsystem 624 may include wired and/or wireless communication devices compatible with one or more different communication protocols. As non-limiting examples, the communication subsystem may be configured for communication via a wireless telephone network, or a wired or wireless local- or wide-area network. In some embodiments, the communication subsystem may allow computing system 600 to send and/or receive messages to and/or from other devices via a network such as the Internet.

The following paragraphs provide additional support for the claims of the subject application. One aspect provides a method for adjusting light output of a display in a user computing device, the method comprising: receiving a plurality of user-adjusted brightness settings from each of a plurality of computing devices; for each of the user-adjusted brightness settings, receiving a corresponding environment brightness level that is determined contemporaneously with an execution of the user-adjusted brightness setting; using the plurality of user-adjusted brightness settings and the corresponding environment brightness levels, generating at least one crowd-sourced brightness curve; determining that a trigger event associated with the user computing device has occurred; and based at least in part on the occurrence of the trigger event, distributing the at least one crowd-sourced brightness curve to the user computing device. The method may additionally or optionally include receiving device characteristic data identifying at least one device characteristic of each of the plurality of computing devices, and wherein generating the at least one crowd-sourced brightness curve further comprises generating a first crowd-sourced brightness curve associated with a first device characteristic, and generating a second crowd-sourced brightness curve associated with a second device characteristic. The method may additionally or optionally include, wherein distributing the at least one crowd-sourced brightness curve to the user computing device further comprises distributing the first crowd-sourced brightness curve based at least in part on identifying the first device characteristic in the user computing device. The method may additionally or optionally include, wherein the first device characteristic comprises a device type. The method may additionally or optionally include, wherein the first device characteristic comprises a size of the display. The method may additionally or optionally include, wherein the first device characteristic comprises a resolution of the display. The method may additionally or optionally include, wherein the first device characteristic comprises a reflectance of the display. The method may additionally or optionally include, wherein the user computing device is a current user computing device that comprises the second device characteristic, the method further comprising: identifying a user-specific brightness curve for a prior user computing device that comprises the first device characteristic; generating a weighted value based on a difference between the first crowd-sourced brightness curve and the second crowd-sourced brightness curve; wherein generating the at least one crowd-sourced brightness curve further comprises modifying the user-specific brightness curve using the weighted value; and distributing the at least one crowd-sourced brightness curve further comprises distributing the modified user-specific brightness curve to the current user computing device. The method may additionally or optionally include receiving device context data identifying at least one context for each of the plurality of computing devices, and wherein generating the at least one crowd-sourced brightness curve further comprises generating a first crowd-sourced brightness curve associated with a first device context, and generating a second crowd-sourced brightness curve associated with a second device context. The method may additionally or optionally include, wherein the plurality of user-adjusted brightness settings comprises a plurality of user-adjusted brightness settings received from the user computing device, and the at least one crowd-sourced brightness curve is generated from at least the plurality of user-adjusted brightness settings received from the user computing device. The method may additionally or optionally include, wherein the user computing device is not one of the plurality of computing devices.

Another aspect provides a computing device, comprising: a display; a light sensor; a processor; and a display adjustment program executable by the processor, the display adjustment program configured to: receive a crowd-sourced brightness curve from a crowd-sourcing computing device, wherein the crowd-sourced brightness curve is generated using (1) a plurality of user-adjusted brightness settings from each of a plurality of other computing devices, and (2) a corresponding environment brightness level for each of the user-adjusted brightness settings, wherein each of the corresponding environment brightness levels is determined contemporaneously with an execution of the user-adjusted brightness setting; and adjust a brightness of the display using the crowd-sourced brightness curve and an ambient light level from the light sensor. The computing device may additionally or alternatively include, wherein the display adjustment program is further configured to send device characteristic data identifying a device characteristic of the computing device to the crowd-sourcing computing device, and wherein the crowd-sourced brightness curve is associated with the first device characteristic. The computing device may additionally or alternatively include, wherein the device characteristic comprises a device type of the computing device. The computing device may additionally or alternatively include, wherein the device characteristic comprises a size of the display. The computing device may additionally or alternatively include, wherein the device characteristic comprises a resolution of the display. The computing device may additionally or alternatively include, wherein the device characteristic comprises a technology type of the display. The computing device may additionally or alternatively include, wherein the device characteristic comprises a reflectance of the display. The computing device may additionally or alternatively include, wherein the plurality of user-adjusted brightness settings further comprises a plurality of user-adjusted brightness settings from the computing device, and the crowd-sourced brightness curve is generated from at least the plurality of user-adjusted brightness settings from the user computing device.

Another aspect provides a computing device, comprising: a processor; and a brightness curve program executable by the processor, the brightness curve program configured to: receive a plurality of user-adjusted brightness settings from each of a plurality of computing devices; for each of the user-adjusted brightness settings, receive a corresponding environment brightness level that is determined contemporaneously with an execution of the user-adjusted brightness setting; using the plurality of user-adjusted brightness settings and the corresponding environment brightness levels, generate at least one crowd-sourced brightness curve; determine that a trigger event associated with a user computing device has occurred; and based at least in part on the occurrence of the trigger event, distribute the at least one crowd-sourced brightness curve to the user computing device.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A method for adjusting light output of a display in a user computing device, the method comprising:

receiving a plurality of user-adjusted brightness settings from each of a plurality of computing devices;

for each of the user-adjusted brightness settings, receiving a corresponding environment brightness level that is determined contemporaneously with an execution of the user-adjusted brightness setting;

using the plurality of user-adjusted brightness settings and the corresponding environment brightness levels, generating at least one crowd-sourced brightness curve;

determining that a trigger event associated with the user computing device has occurred; and based at least in part on the occurrence of the trigger event, distributing the at least one crowd-sourced brightness curve to the user computing device.

2. The method of claim 1, further comprising receiving device characteristic data identifying at least one device characteristic of each of the plurality of computing devices, and wherein generating the at least one crowd-sourced brightness curve further comprises generating a first crowd-sourced brightness curve associated with a first device characteristic, and generating a second crowd-sourced brightness curve associated with a second device characteristic.

3. The method of claim 2, wherein distributing the at least one crowd-sourced brightness curve to the user computing device further comprises distributing the first crowd-sourced brightness curve based at least in part on identifying the first device characteristic in the user computing device.

4. The method of claim 2, wherein the first device characteristic comprises a device type.

5. The method of claim 2, wherein the first device characteristic comprises a size of the display.

6. The method of claim 2, wherein the first device characteristic comprises a resolution of the display.

7. The method of claim 2, wherein the first device characteristic comprises a reflectance of the display.

8. The method of claim 2, wherein the user computing device is a current user computing device that comprises the second device characteristic, the method further comprising:

identifying a user-specific brightness curve for a prior user computing device that comprises the first device characteristic;

generating a weighted value based on a difference between the first crowd-sourced brightness curve and the second crowd-sourced brightness curve;

wherein generating the at least one crowd-sourced brightness curve further comprises modifying the user-specific brightness curve using the weighted value; and distributing the at least one crowd-sourced brightness curve further comprises distributing the modified user-specific brightness curve to the current user computing device.

9. The method of claim 1, further comprising receiving device context data identifying at least one context for each of the plurality of computing devices, and wherein generating the at least one crowd-sourced brightness curve further comprises generating a first crowd-sourced brightness curve associated with a first device context, and generating a second crowd-sourced brightness curve associated with a second device context.

10. The method of claim 1, wherein the plurality of user-adjusted brightness settings comprises a plurality of user-adjusted brightness settings received from the user computing device, and the at least one crowd-sourced brightness curve is generated from at least the plurality of user-adjusted brightness settings received from the user computing device.

11. The method of claim 1, wherein the user computing device is not one of the plurality of computing devices.

12. A computing device, comprising:

a display;

a light sensor;

a processor; and a display adjustment program executable by the processor, the display adjustment program configured to:

receive a crowd-sourced brightness curve from a crowd-sourcing computing device, wherein the crowd-sourced brightness curve is generated using (1) a plurality of user-adjusted brightness settings from each of a plurality of other computing devices, and (2) a corresponding environment brightness level for each of the user-adjusted brightness settings, wherein each of the corresponding environment brightness levels is determined contemporaneously with an execution of the user-adjusted brightness setting; and adjust a brightness of the display using the crowd-sourced brightness curve and an ambient light level from the light sensor.

13. The computing device of claim 12, wherein the display adjustment program is further configured to send device characteristic data identifying a device characteristic of the computing device to the crowd-sourcing computing device, and wherein the crowd-sourced brightness curve is associated with the first device characteristic.

14. The computing device of claim 13, wherein the device characteristic comprises a device type of the computing device.

15. The computing device of claim 13, wherein the device characteristic comprises a size of the display.

16. The computing device of claim 13, wherein the device characteristic comprises a resolution of the display.

17. The computing device of claim 13, wherein the device characteristic comprises a technology type of the display.

18. The computing device of claim 13, wherein the device characteristic comprises a reflectance of the display.

19. The computing device of claim 12, wherein the plurality of user-adjusted brightness settings further comprises a plurality of user-adjusted brightness settings from the computing device, and the crowd-sourced brightness curve is generated from at least the plurality of user-adjusted brightness settings from the user computing device.

20. A computing device, comprising:

a processor; and a brightness curve program executable by the processor, the brightness curve program configured to:

receive a plurality of user-adjusted brightness settings from each of a plurality of computing devices;

for each of the user-adjusted brightness settings, receive a corresponding environment brightness level that is determined contemporaneously with an execution of the user-adjusted brightness setting;

using the plurality of user-adjusted brightness settings and the corresponding environment brightness levels, generate at least one crowd-sourced brightness curve;

determine that a trigger event associated with a user computing device has occurred; and based at least in part on the occurrence of the trigger event, distribute the at least one crowd-sourced brightness curve to the user computing device.

* * * * *